US005444979A

United States Patent [19]

Funami et al.

[11] Patent Number: 5,444,979

[45] Date of Patent: Aug. 29, 1995

[54] FLUID PASSAGE CONTROL DEVICE FOR FLUID PRESSURE ACTUATOR

[75] Inventors: Yasuo Funami; Hisao Takayanagi; Omito Toyoshima, all of Saitama, Japan

[73] Assignee: Showa Corporation, Saitama, Japan

[21] Appl. No.: 274,552

[22] Filed: Jul. 13, 1994

Related U.S. Application Data

[63] Continuation-in-part of Ser. No. 55,030, Apr. 30, 1993, abandoned.

[30] Foreign Application Priority Data

Apr. 30, 1992 [JP] Japan ..... 4-36299

[51] Int. Cl.[6] ..... F15B 7/00

[52] U.S. Cl. ..... 60/460; 60/476; 137/106; 440/61

[58] Field of Search ..... 60/460, 476; 137/106; 440/61

[56] References Cited

U.S. PATENT DOCUMENTS 3,885,517 5/1975 Borst et al. .
4,064,824 12/1977 Hall et al. .
4,096,820 6/1978 Hall .
4,325,700 4/1982 Kern et al. .
4,363,629 12/1982 Hall et al. .
4,391,592 7/1983 Hundertmark .
4,557,696 12/1985 Nakahama .
4,565,528 1/1986 Nakase .
4,631,035 12/1986 Nakahama ..... 440/61
5,032,094 7/1991 Katogi .
5,049,099 9/1991 Ito et al. .

FOREIGN PATENT DOCUMENTS 62-37298 2/1987 Japan ..... 440/61

*Primary Examiner*—Gerald A. Michalsky
*Attorney, Agent, or Firm*—Howard L. Rose

[57] ABSTRACT

A tilt cylinder for tilting an outboard engine has first and second cylinder chambers. A pair of on/off valves is movably disposed in respective fluid passages connected to a hydraulic pump and the first and second cylinder chambers, respectively. The on/off valves are operatively combined with respective shuttle valves which have respective oil passages in facing relationship to the on/off valves, respectively, and respective ball valve bodies for selectively opening the oil passage into communication with each other. When the hydraulic pump is actuated to develop a working oil pressure buildup, one of the on/off valves is opened by the working oil pressure buildup to establish an oil supply passage from the hydraulic pump to one of the first and second chambers, and the other of the on/off valves is opened by the coacting shuttle valve which is moved by the working oil pressure buildup to establish an oil return passage from the other of the first and second chambers to the hydraulic pump. The shuttle valves have respective auxiliary passages communicating with the oil passages, respectively, and the oil supply and return passages, respectively.

5 Claims, 5 Drawing Sheets

FLUID PASSAGE CONTROL DEVICE FOR FLUID PRESSURE ACTUATOR

RELATED APPLICATION

This application is a continuation-in-part of application Ser. No. 08/055,030 filed Apr. 30, 1993, now abandoned.

BACKGROUND OF THE INVENTION

1. Field of the Invention

The present invention relates to a fluid passage control device for controlling a fluid pressure actuator such as a tilt cylinder of a power tilt and trim mechanism for an outboard engine.

2. Description of the Prior Art

Some small boats such as motorboats are equipped with a power tilt and trim mechanism having a tilt cylinder for lowering and lifting the outboard engine into and out of the water, and a trim cylinder for changing the angle of the outboard engine underwater.

One such power tilt and trim mechanism comprises first and second on/off valves disposed in fluid passages from a hydraulic pump to respective first and second cylinder chambers in the tilt cylinder, and first and second shuttle valves movably positioned in confronting relationship to the first and second on/off valves, respectively. The first and second shuttle valves have oil passages defined therein and ball valve bodies for selectively opening and closing the oil passages, the oil passages being connected by a communication passage.

When working oil is discharged from the hydraulic pump, the first on/off valve is opened under the pressure of the working oil, opening the fluid passage connected to the first cylinder chamber. The first shuttle valve is also opened under the pressure of the working oil, opening the oil passage thereof. The working oil now flows from the oil passage of the first shuttle valve, pushing open the ball valve body, and flows through the communication passage to the second shuttle valve. Since, however, the ball valve body of the second shuttle valve blocks the working oil, the pressure of the working oil acts on the second shuttle valve. The second shuttle valve is then moved, pushing open the second on/off valve thereby to open the return fluid passage from the second cylinder chamber. The tilt cylinder is now contracted to tilt the outboard engine downwardly.

When the hydraulic pump is shut off, the first on/off valve which has been open so far is closed, and the first shuttle valve returns to close the oil passage thereof with the first on/off valve. The oil passage of the second shuttle valve has been closed by the ball valve body. Consequently, the working oil is trapped in the communication passage which interconnects the shuttle valves. Under the pressure of the working oil trapped in the communication passage, the second shuttle valve is caused to keep the second on/off valve open. The return fluid passage from the tilt cylinder to the hydraulic pump thus remains open. Therefore, when the outboard engine is tilted downwardly, it continuously moved downwardly due to gravity.

U.S. Pat. No. 4,493,659 discloses a tilt-lock mechanism for use with an outboard engine.

SUMMARY OF THE INVENTION

It is therefore an object of the present invention to provide a fluid passage control device for controlling a fluid pressure actuator of a power tilt and trim mechanism for an outboard engine, the fluid passage control device having a means for preventing a fluid passage for returning working oil from a tilt cylinder chamber back to a hydraulic from being kept open after the outboard engine is tilted downwardly by the fluid pressure actuator.

According to the present invention, there is provided a fluid passage control device for controlling a fluid pressure actuator having first and second chambers, comprising a hydraulic pump, a pair of on/off valves movably disposed in respective fluid passages connected to the hydraulic pump and adapted to be connected to the first and second chambers, respectively, and a pair of shuttle valves movably positioned in coaction with the on/off valves, respectively, the shuttle valves having respective oil passages defined therein in facing relationship to the on/off valves, respectively, and respective ball valve bodies for selectively opening the oil passages into communication with each other, the arrangement being such that when the hydraulic pump is actuated to develop a working oil pressure buildup, one of the on/off valves is opened by the working oil pressure buildup to establish an oil supply passage from the hydraulic pump to one of the first and second chambers, and the other of the on/off valves is opened by the coacting shuttle valve which is moved by the working oil pressure buildup to establish an oil return passage from the other of the first and second chambers to the hydraulic pump, at least the shuttle valve associated with moving the outboard engine into the water has an auxiliary passage communicating with its oil passage and the oil supply and return passage. Although only the aforesaid shuttle valve is required to have an auxiliary passage both shuttle valves may have such passages as is explained in more detail in the detailed description.

The shuttle valves have respective tip ends held in contact with the on/off valves, the auxiliary passage or passages being defined near the tip ends of the shuttle valve or valves.

The oil passages are defined axially in the shuttle valves, respectively, and the auxiliary passage or passages are defined radially in the shuttle valves.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
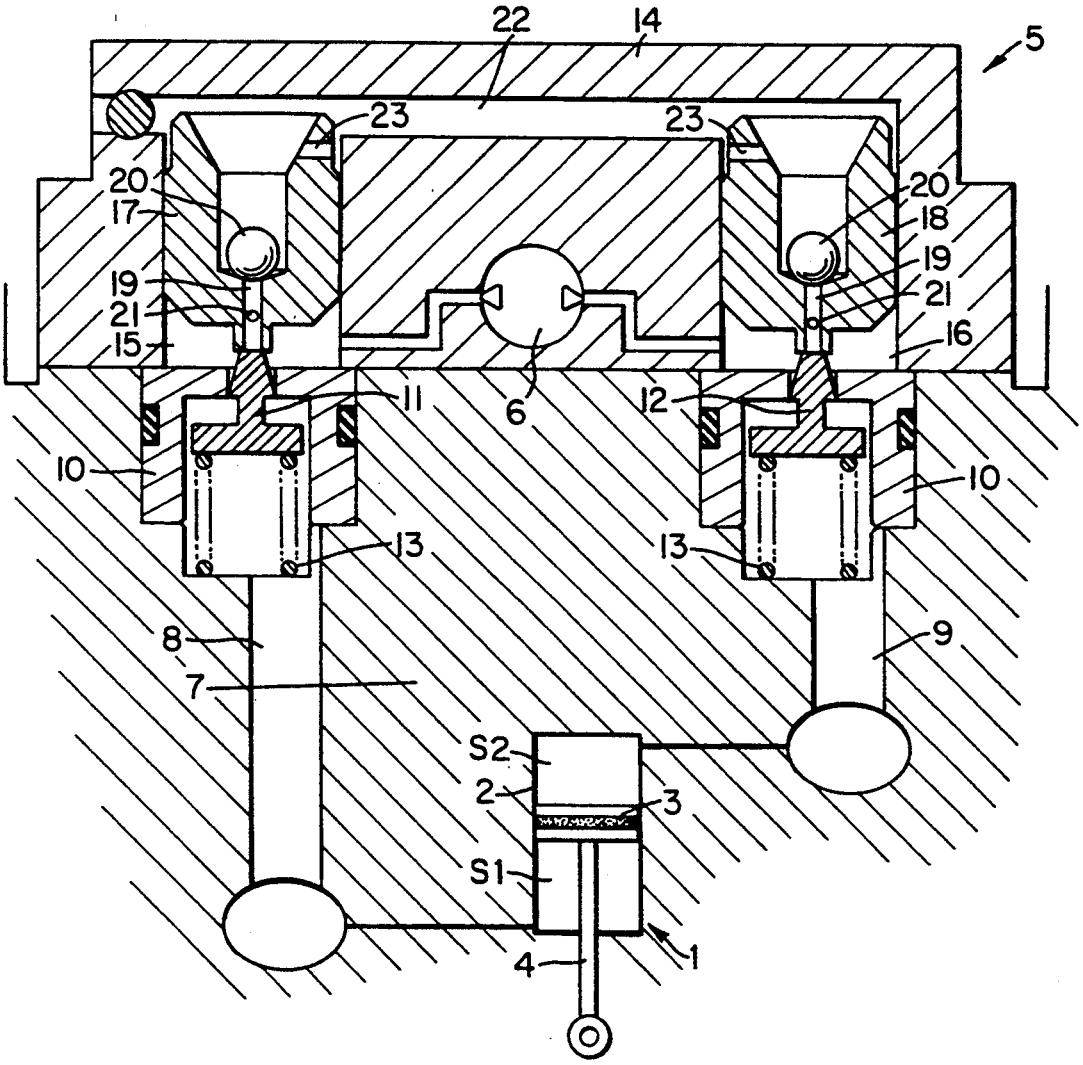
FIG. 1 is a cross-sectional view of a fluid passage control device for an actuator according to the present invention.

As shown in FIG. 1, a tilt cylinder 1 for use as a hydraulic pressure actuator to tilt an outboard engine (not shown) upwardly and downwardly comprises a cylinder 2 and a piston 3 slidably fitted therein. The piston 3 divides the interior space of the cylinder 2 into a first cylinder chamber S1 and a second cylinder chamber S2. The outboard engine is supported on a bracket which is coupled to an end of a rod 4 whose other end is connected to the piston 3.

Working oil is supplied to and discharged from the tilt cylinder 1 under the control of a fluid passage control device 5. The fluid passage control device 5 comprises a gear pump 6 disposed in a valve block 14, a pair of fluid passages 8, 9 defined in a valve block 7 secured to the valve block 14 and communicating between the gear pump 6 and the first and second cylinder chambers S1, S2, and a pair of first and second on/off valves 11, 12 movably disposed in respective valve cases 10 in the fluid passages 8, 9. The first and second on/off valves 11, 12 are normally urged in a direction to close the fluid passages 8, 9 under the bias of respective return springs 13.

The valve block 14 has a pair of valve chambers 15, 16 communicating with the gear pump 6 and the fluid passages 8, 9 and having respective ends closed by the valve cases 10. The valve chambers 15, 16 house respective first and second shuttle valves 17, 18 that are movably positioned in confronting relationship to and in contact with the first and second on/off valves 11, 12. Specifically, the first and second shuttle valves 17, 18 have respective tip ends held in contact with the respective first and second on/off valves 11, 12.

Figure 2:
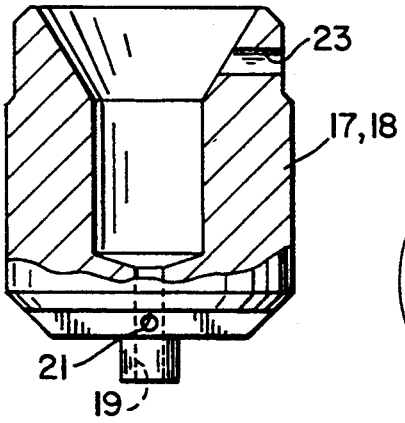
FIG. 2 is a fragmentary cross-sectional view of a shuttle valve of the fluid passage control device.
Figure 3:
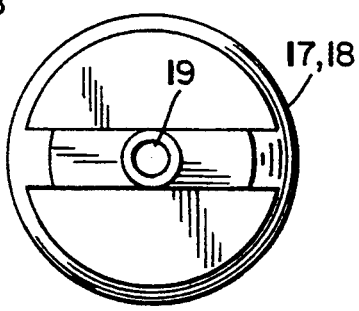
FIG. 3 is a bottom view of the shuttle valve.
Figure 4:
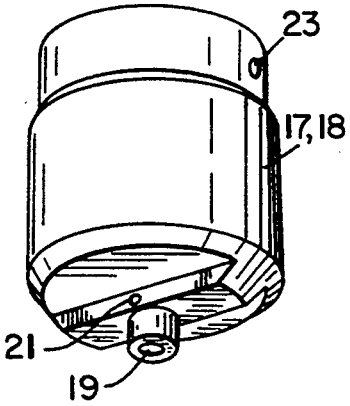
FIG. 4 is a perspective view of the shuttle valve.

As also shown in FIGS. 2 through 4, the first and second shuttle valves 17, 18 have oil passages 19 axially defined respectively therein which have axial ends facing the first and second on/off valves 11, 12 and opposite axial ends openably closed by respective ball valve bodies 20 that are disposed in the first and second shuttle valves 17, 18, respectively. The first and second shuttle valves 17, 18 also have respective auxiliary passages 21 defined laterally or radially in the vicinity of the tip ends thereof. The auxiliary passages 21 (both being shown in FIGS. 1–4) communicate between the oil passages 19 and the valve chambers 15, 16 and do not face the first and second on/off valves 11, 12.

When the oil passages 19 are not closed by the respective ball valve bodies 20, the oil passages 19 of the first and second shuttle valves 17, 18 are held in communication with each other through a communication passage 22 defined in the valve case 14. The first and second shuttle valves 17, 18 have respective oil passages 23 defined laterally remotely from the tip ends thereof. The oil passages 23 serve to provide communication between the oil passages 19 and the communication passage 22 when the ends of the first and second shuttle valves 17, 18 remote from the tip ends thereof abut against a wall surface of the valve case 14 which defines the communication passage 22.

The fluid passage control device 5 operates as follows: when the gear pump 6 rotates in a normal direction and supplies working oil to the valve chamber 16, the second on/off valve 12 is lowered under the pressure of the working oil against the bias of the return spring 13, thus opening the fluid passage 9. Therefore, the working oil is supplied through the fluid passage 9 to the second cylinder chamber S2 of the tilt cylinder 1.

The pressure buildup in the valve chamber 16 elevates the second shuttle valve 18, allowing the working oil to flow from the oil passage 19 into the communication passage 22 while pushing open the ball valve body 20. At this time, since the oil passage 19 of the first shuttle valve 17 is closed by the corresponding ball valve body 20, the first shuttle valve 17 is lowered causing its tip end to lower the first on/off valve 11, opening the fluid 8. Working oil in the first cylinder chamber S1 of the tilt cylinder 1 is now allowed to flow back to the gear pump 6.

The rod 4 of the tilt cylinder 1 is extended to tilt the outboard engine upwardly. When the gear pump 6 is shut off, the second on/off valve 12 is not subjected to the working oil pressure and hence is lifted under the bias of the return spring 13, closing the fluid passage 9. Inasmuch as the working oil is no longer supplied to the second cylinder chamber S2, the outboard engine stops its upwardly tilting movement.

Figure 5:
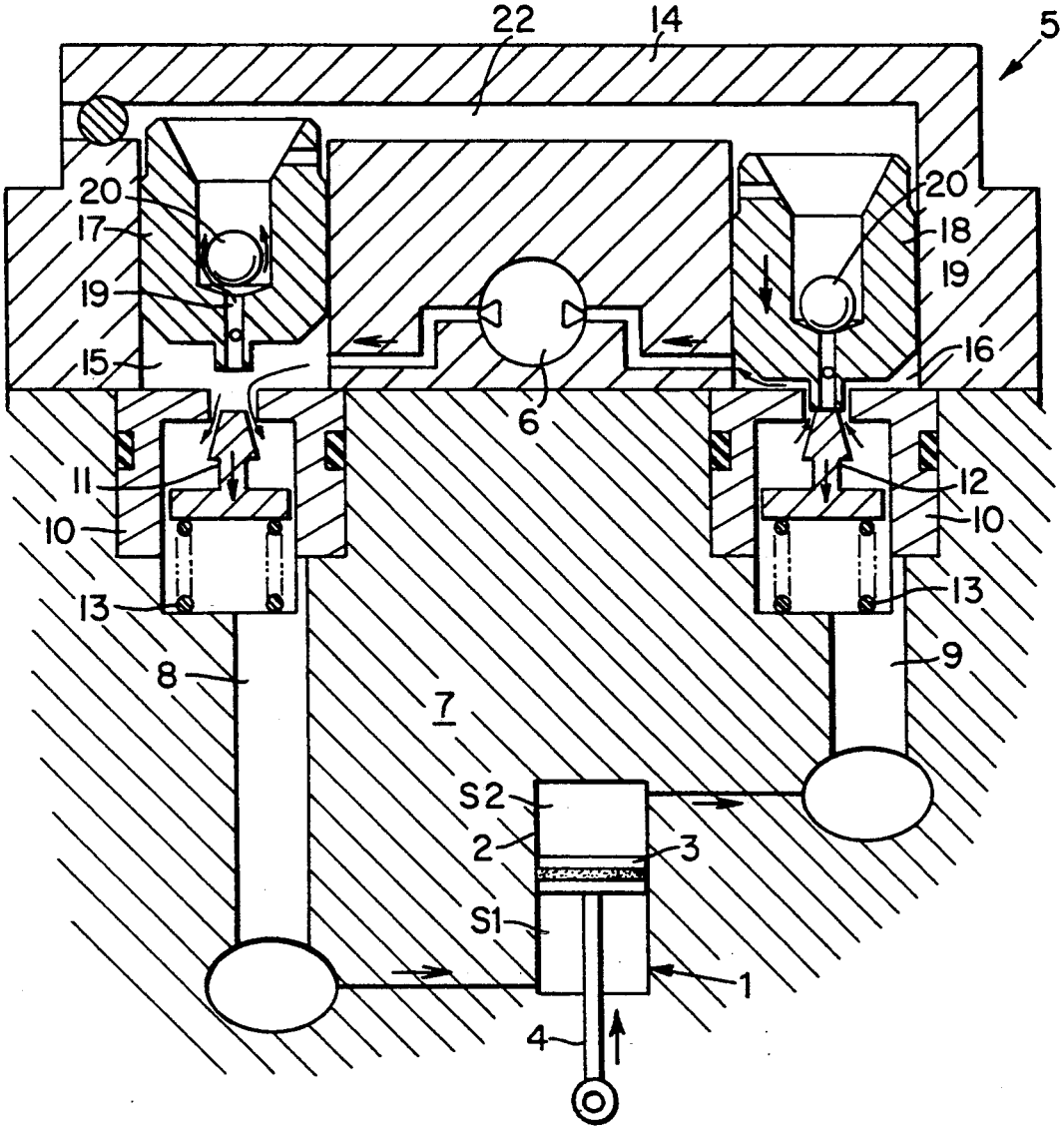
FIG. 5 illustrates the position of the valves during a tilt down operation with the pump running.

When the gear pump 6 rotates in the reverse direction the engine is lower so that the propeller is in the water. Such operation supplies working oil to the valve chamber 15, the pressure of the working oil depresses the first on/off valve 11 against the bias of its return spring 13, thus opening the fluid passage 8. Therefore, the working oil is supplied through the fluid passage 8 to the first cylinder chamber S1 of the tilt cylinder 1, see FIG. 5.

Upon the pressure buildup in the valve chamber 15, the first shuttle valve 17 is lifted, allowing the working oil to flow from the oil passage 19 into the communication passage 22 while pushing open the ball valve body 20 of the shuttle valve 17. Because the oil passage 19 of the second shuttle valve 18 is closed by its corresponding ball valve body 20 as a result of pressure in passage 22, the second shuttle valve 18 is lowered causing its tip end to lower the second on/off valve 12, opening the fluid passage 9. The working oil is now allowed to flow from the second cylinder chamber S2 back to the gear pump 6.

Figure 6:
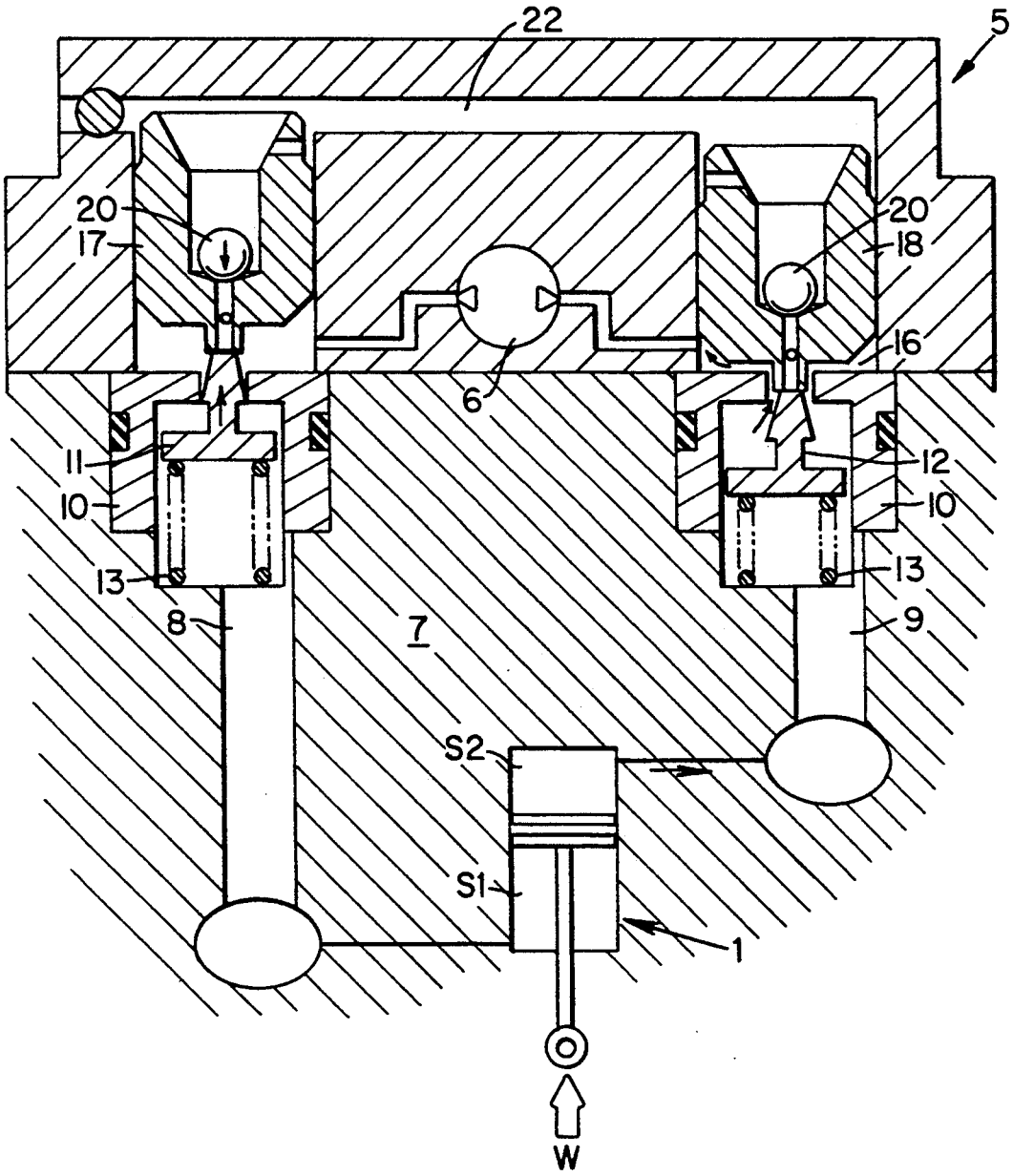
FIG. 6 illustrates the position of the valves upon termination of operation of the pump.

The rod 4 of the tilt cylinder 1 is contracted to tilt the outboard engine downwardly. When the gear pump 6 is shut off, no working oil pressure acts on the first on/off valve 11, which is thus lifted under the bias of the return spring 13, closing the fluid passage 8, see FIG. 6. No working oil is supplied to the first cylinder chamber S1, and the outboard engine stops its downwardly tilting movement.

Figure 7:
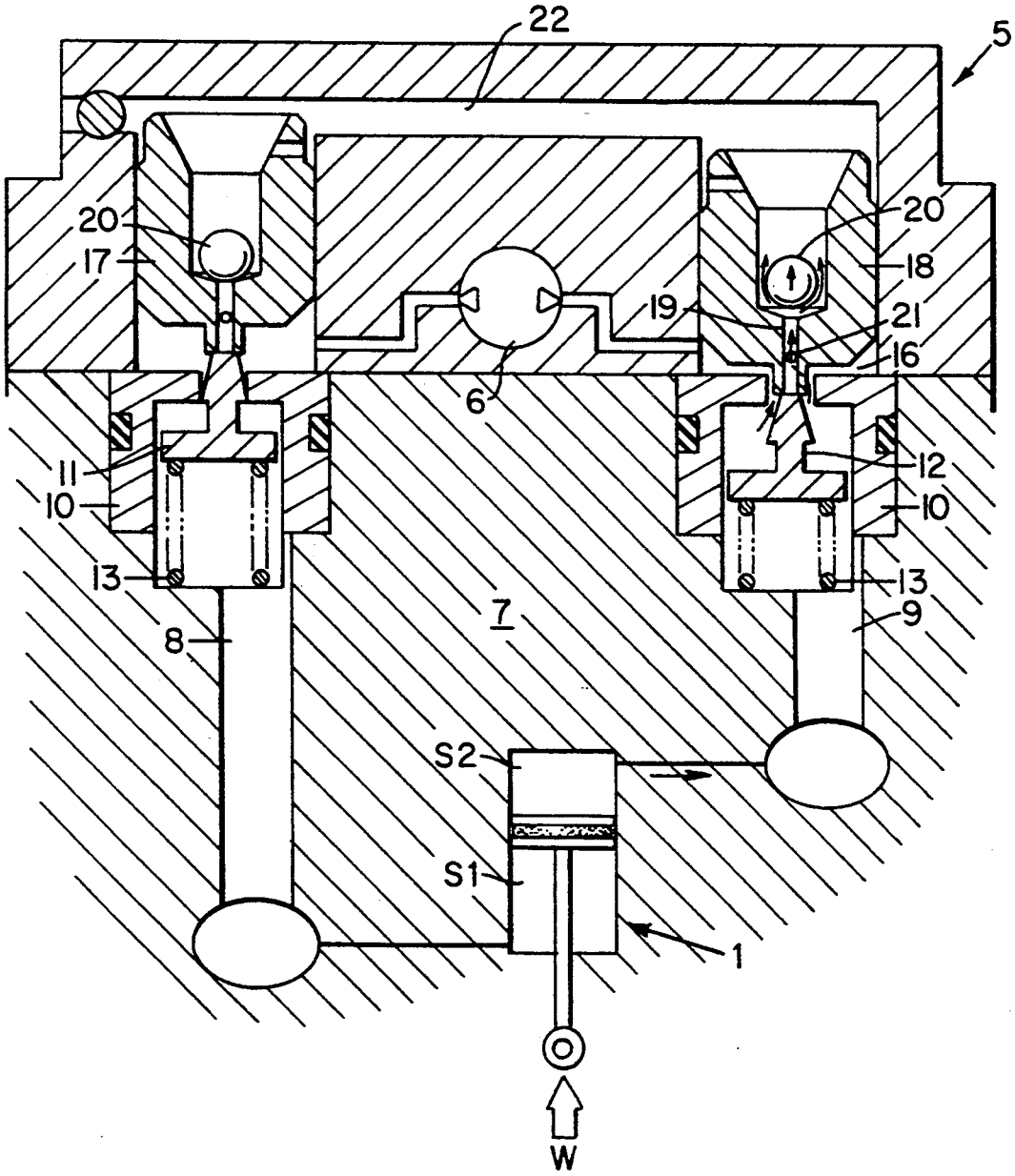
FIG. 7 illustrates the need for the auxiliary passage upon termination of operation of the pump and the effect of the weight of the outboard engine.

At this time, as no working oil is supplied to the valve chamber 15, the first shuttle valve 17 is lowered to cause the first on/off valve 11 and the ball valve body 20 to close the oil passage 19. Since the weight of the outboard engine is borne by the rod 4, a high pressure buildup is temporarily developed in the valve chamber 16 when the fluid passage 9 is opened by the second on/off valve 12. The working oil in the valve chamber 16 flows from the auxiliary passage 21 of the second shuttle valve 18 through the oil passage 19, pushing open the ball valve body 20, see FIG. 7.

At this time, the second on/off valve 12 tends to close the fluid passage 9 under the bias of the return spring 13.

However, in the event of the second shuttle valve 12 having no auxiliary passage 21 defined in vicinity of the tip end thereof, the second shuttle valve 18 will be unable to smoothly move due to a high pressure of the working oil trapped in the communication passage 22. As a result, it will take a long time to close the fluid passage 9 by the second on/off valve 12 because of the depression of the second shuttle valve 18 to the second on/off valve 12. Also, during this period of time, the rod 4 on which the weight of the outboard engine is loaded will be unable to keep stationary relative to the tilt cylinder 1, causing the outboard engine to be continuously moved downwardly.

On the other hand, with the second shuttle valve 18 having the auxiliary passage 21 according to the present invention, the working oil, which is under a high pressure buildup developed in the fluid passage 9 instantaneously after the gear pump 6 is shut off, is allowed to flow through the auxiliary passage 21 from the fluid passage 9 into the oil passage 19 to push open the ball valve 20 of the second shuttle valve 18. Consequently, the high pressure of working oil trapped in the communication passage 22 can be lowered in a moment and then the second shuttle valve 18 can be lifted upwardly together with the second on/off valve 12 under the bias of the return spring 13, see FIG. 7. Accordingly, the fluid passage 9 (serving as a part of a return passage from the second cylinder chamber S2 to the gear pump 6) can be closed by the second on/off valve 12 in a shorter period of time in comparison with the case of no auxiliary passage 21 defined on the second shuttle valve 18.

Figure 8:
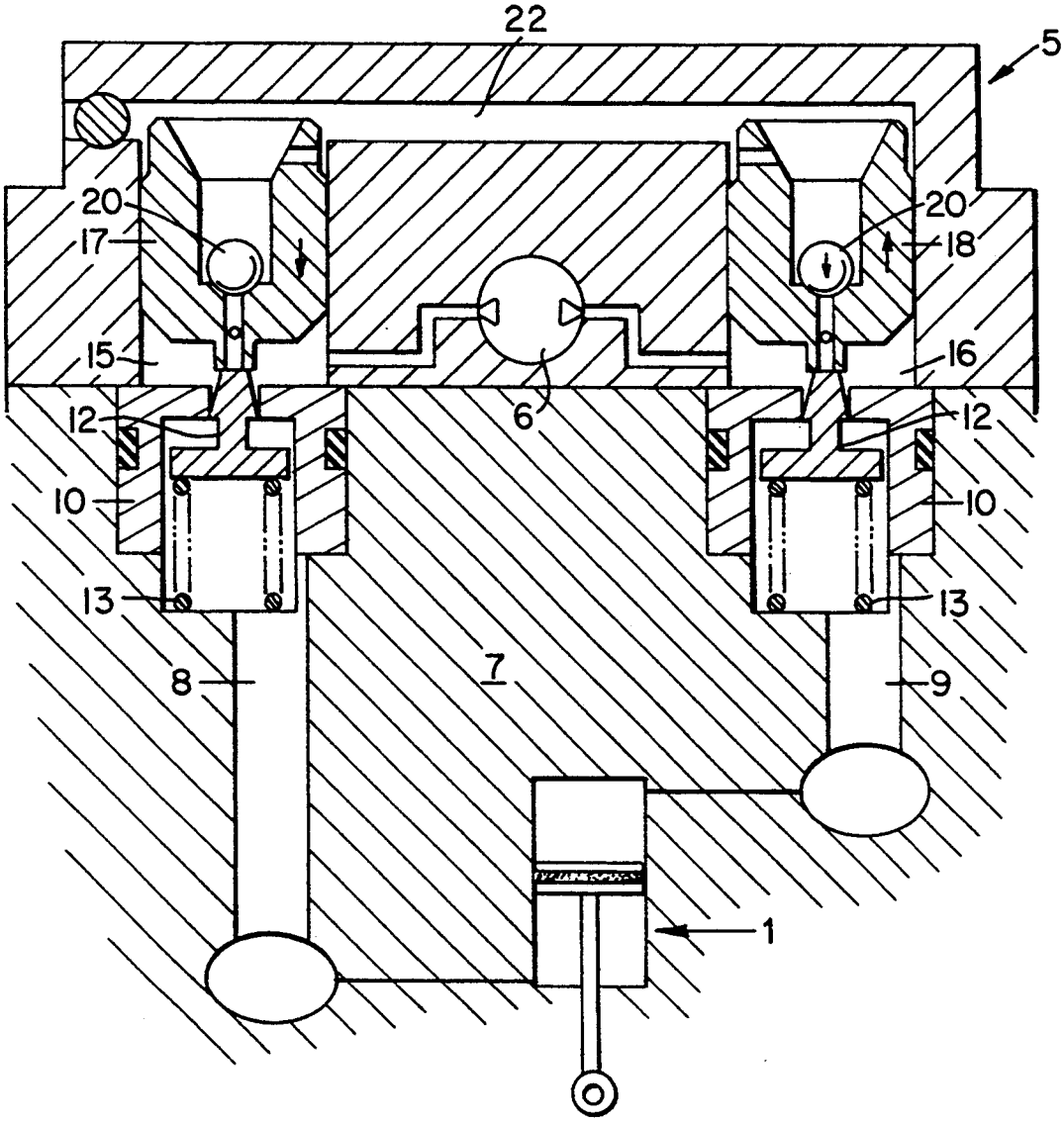
FIG. 8 illustrates the final position of the valves after a tilt down operation; that is, placement of the engine in the down position.

Also, during this upward lifting of the second shuttle valve 18 together with the second on/off valve 12 under the bias of the return spring 13, the first shuttle valve 17 can be lowered to return to its initial position by action of the working oil in the communication passage 22, see FIG. 8.

Thus, the working oil in the second cylinder chamber S2 is now locked or trapped, preventing the rod 4 from being lowered further under the weight of the outboard engine.

Inasmuch as the auxiliary passage 21 of the second shuttle valve 18 serves to relieve the communication passage 22 of the trapped working oil pressure buildup, the second shuttle valve 18 is prevented from being locked in a condition to keep the second on/off valve 12 open. Accordingly, the fluid passage 9 for returning the working oil from the second cylinder chamber S2 back to the gear pump 6 is prevented from being kept open after the outboard engine is tilted downwardly by the tilt cylinder 1.

It should be noted that the auxiliary passage 21 is significant to be provided on such a shuttle valve of the two shuttle valves 17, 18 (i.e., the second shuttle valve 18) as being in communication with the cylinder chamber S2 which is full of the working oil under a high pressure caused by the weighty load of the outboard engine. However, even if the first shuttle valve 17 has the auxiliary passage 21 in addition to the auxiliary passage 21 of the second shuttle valve 18 as shown in FIG. 1, the provision of such extra auxiliary passage 21 on the first shuttle valve 17 never adversely affects the advantageous operation as described above but suitable for fail-safe purposes in the event of a failure by incorrectly assembling the first shuttle valve 17 into the valve chamber 16 while the second shuttle valve 18 assembled into the valve chamber 15.

Although there has been described what is at present considered to be the preferred embodiment of the invention, it will be understood that the invention may be embodied in other specific forms without departing from the essential characteristics thereof. The present embodiment is therefore to be considered in all respects as illustrative, and not restrictive. The scope of the invention is indicated by the appended claims rather than by the foregoing description.

What is claimed is:

1. A fluid passage control device for controlling a fluid pressure actuator having first and second chambers, a hydraulic pump for developing hydraulic pressure in said device, oil supply passages each connected between said pump and a different one of said first and second chambers, a different on/off valve located in each fluid passage, a pair of shuttle valves each positioned to coact with a different one of said on/off valves, said shuttle valves having oil passages therein each in facing relationship to said on/off valves, ball valves each providing communication between oil passages in said shuttle valve and said on/off valves, means responsive to hydraulic fluid pressure to open one of said on/off valves to direct flow to one of said chambers, means responsive to hydraulic fluid pressure to actuate one of said shuttle valves to open the other of said on/off valves to connect the other of said chambers to a fluid return passage, said actuated one of said shuttle valves having an auxiliary passage for communicating with its oil passage and said return passage.

2. A fluid passage control device according to claim 1, wherein said shuttle valves having respective tip ends held in contact with said on/off valves, and said auxiliary passage being defined near said tip end of said one of said shuttle valves.

3. A fluid passage control device according to claim 1, wherein said oil passages are defined axially in said shuttle valve, respectively, and said auxiliary passage is defined radially in said one of said shuttle valves, respectively.

4. A fluid passage control device according to claim 1, wherein both said shuttle valves have an auxiliary passage communicating each with its associated oil passage.

5. A fluid passage control device comprising first and second chambers, a first pair of fluid passages each for receiving fluid under pressure in the alternative, a different on/off valve each movably disposed in a different one of said fluid passages, each fluid passage connected via an on/off valve to a different one of said chambers, a pair of shuttle valves movably positioned in coaction each with a different one of said on/off valves, said shuttle valves having respective oil passages defined therein each in facing relationship with a different one of said on/off valves, a pair of ball valves each associated with a different shuttle valve for selectively placing said oil passages of said shuttle valves into communication with one another upon one of said first pair of fluid passages being pressurized, each said on/off valve being responsive to fluid pressure developed in its associated fluid passage of said first pair of fluid passages to supply oil under pressure to one of said first and second chambers, said other on/off valve being opened by said shuttle valve receiving fluid under pressure via said oil passages interconnected via one of said ball valves, said shuttle valves further including auxiliary passages communicating with the oil passages of said shuttle valves and the oil supply passages.

* * * * *